United States Patent [19]

Kurosaki

[11] Patent Number: 4,956,857

[45] Date of Patent: Sep. 11, 1990

[54] X-RAY FLUOROSCOPIC APPARATUS

[75] Inventor: Kaoru Kurosaki, Tochigi, Japan

[73] Assignee: Kabushiki Kaisha Toshiba, Kawasaki, Japan

[21] Appl. No.: 217,982

[22] Filed: Jul. 12, 1988

[30] Foreign Application Priority Data

Jul. 16, 1987 [JP] Japan ..... 62-177406

[51] Int. Cl.[5] ..... H05G 1/34

[52] U.S. Cl. ..... 378/110; 378/112; 378/99

[58] Field of Search ..... 358/111; 378/108–112, 378/99, 151, 160

[56] References Cited

U.S. PATENT DOCUMENTS

| | | | |
|---|---|---|---|
| 2,913,582 | 11/1959 | Collins et al. | 378/110 |
| 3,546,461 | 12/1970 | Craig | 378/111 |
| 3,971,945 | 7/1976 | Franke | 378/108 |
| 4,473,843 | 9/1984 | Bishop et al. | 378/99 |
| 4,562,586 | 12/1985 | Honda et al. | 378/108 |
| 4,595,949 | 6/1986 | Fenster et al. | 378/112 |
| 4,636,954 | 1/1987 | Komatsu et al. | 358/111 |
| 4,703,496 | 10/1987 | Meccariello et al. | 378/108 |
| 4,747,118 | 5/1988 | Spaak | 378/108 |

FOREIGN PATENT DOCUMENTS

| | | |
|---|---|---|
| 0114369 | 1/1984 | European Pat. off. . |
| 0126434 | 11/1984 | European Pat. Off. . |
| 2846458 | 5/1980 | Fed. Rep. of Germany . |
| 3309469 | 9/1983 | Fed. Rep. of Germany . |
| 3424054 | 1/1986 | Fed. Rep. of Germany . |

*Primary Examiner*—Craig E. Church
*Assistant Examiner*—John C. Freeman
*Attorney, Agent, or Firm*—Oblon, Spivak, McClelland, Maier & Neustadt

[57] ABSTRACT

An F-kV and an F-mA output from tube-voltage adjuster and tube-current adjuster, respectively, are supplied to exposure-rate controller. Controller compares an input entrance exposure rate determined by the F-kV and the F-mA with a preset exposure rate set in view of a patient's safety. When the former is equal to or less than the latter, controller supplies the input F-kV and F-mA to X-ray tube. When the former exceeds the latter, controller supplies an F-kV and an F-mA corresponding to the preset exposure rate to X-ray tube and a limit signal to auto-iris controller. X-rays output from X-ray tube are transmitted through patient to form an X-ray image. The X-ray image is converted into an optical image by image intensifier tube. After the light quantity of the optical image is reduced by auto-iris, the optical image is picked up by TV camera. TV camera outputs an image signal to TV monitor and brightness detector. Brightness detector detects the brightness of an image displayed on TV monitor, and outputs it to auto-iris controller. In the normal mode wherein no limit signal is supplied, auto-iris controller closes auto-iris based on the operation method and the input size of the field of view of the image intensifier tube. When a limit signal is input, auto-iris controller opens auto-iris such that an output from brightness detector becomes a predetermined value.

8 Claims, 2 Drawing Sheets

X-RAY FLUOROSCOPIC APPARATUS

BACKGROUND OF THE INVENTION

1. Field of the Invention

The present invention relates to an X-ray fluoroscopic apparatus for limiting an entrance exposure rate representing an X-ray quantity per unit time radiated onto a patient.

2. Description of the Related Art

With an X-ray fluoroscopic apparatus, X-rays are radiated onto a patient, an image obtained from the transmitted X-rays is converted into an optical image by an image intensifier tube, the optical image is picked up by a TV camera and displayed on a TV monitor, and a diagnosis is made based on the displayed image.

In an X-ray fluoroscopic apparatus of this type, the X-ray quantity radiated onto a patient per unit time, i.e., the entrance exposure rate must be limited in view of patient's safety. In the H.H.S standards of the United States, the entrance exposure rate must be 10 R/sec. if the X-ray fluoroscopic apparatus has an automatic entrance exposure rate limiter, and 5 R/sec. if otherwise. These values are determined in view of the diagnostic resolving power and the safety of the patient.

When the entrance X-ray quantity is constant, the X-ray quantity transmitted through the patient varies depending on the patient's body thickness. However, the values cited above are not determined considering the patient's body thickness. When the patient's body thickness is large, the transmitted X-ray quantity is decreased, which decreases the brightness of the image displayed on the monitor, thereby resulting in a decrease in diagnostic precision.

SUMMARY OF THE INVENTION

It is an object of the present invention to provide an X-ray fluoroscopic apparatus wherein an entrance exposure rate is controlled so as to decrease the X-ray quantity radiated onto a patient while maintaining the brightness of an image displayed on a monitor, thus enabling high-precision diagnosis.

The X-ray fluoroscopic apparatus according to the present invention comprises: a TV camera having an iris closed to a predetermined value and for picking up, through the iris, a fluoroscopic image of an object to be examined which is obtained from X-rays transmitted through the object; a circuit for inputting a tube voltage and a tube current of an X-ray tube; and an exposure rate controller for comparing an input entrance exposure rate corresponding to the input tube voltage and the input tube current with a predetermined reference exposure rate, for setting the input tube voltage and the input tube current in the X-ray tube when the input entrance exposure rate is equal to or less than the reference exposure rate, and for setting a tube voltage and a tube current corresponding to the reference exposure rate and opening the iris to set the brightness of the image picked up by the TV camera at a desired value when the input entrance exposure rate is larger than the reference exposure rate.

DETAILED DESCRIPTION OF THE PREFERRED EMBODIMENT

Figure 1:
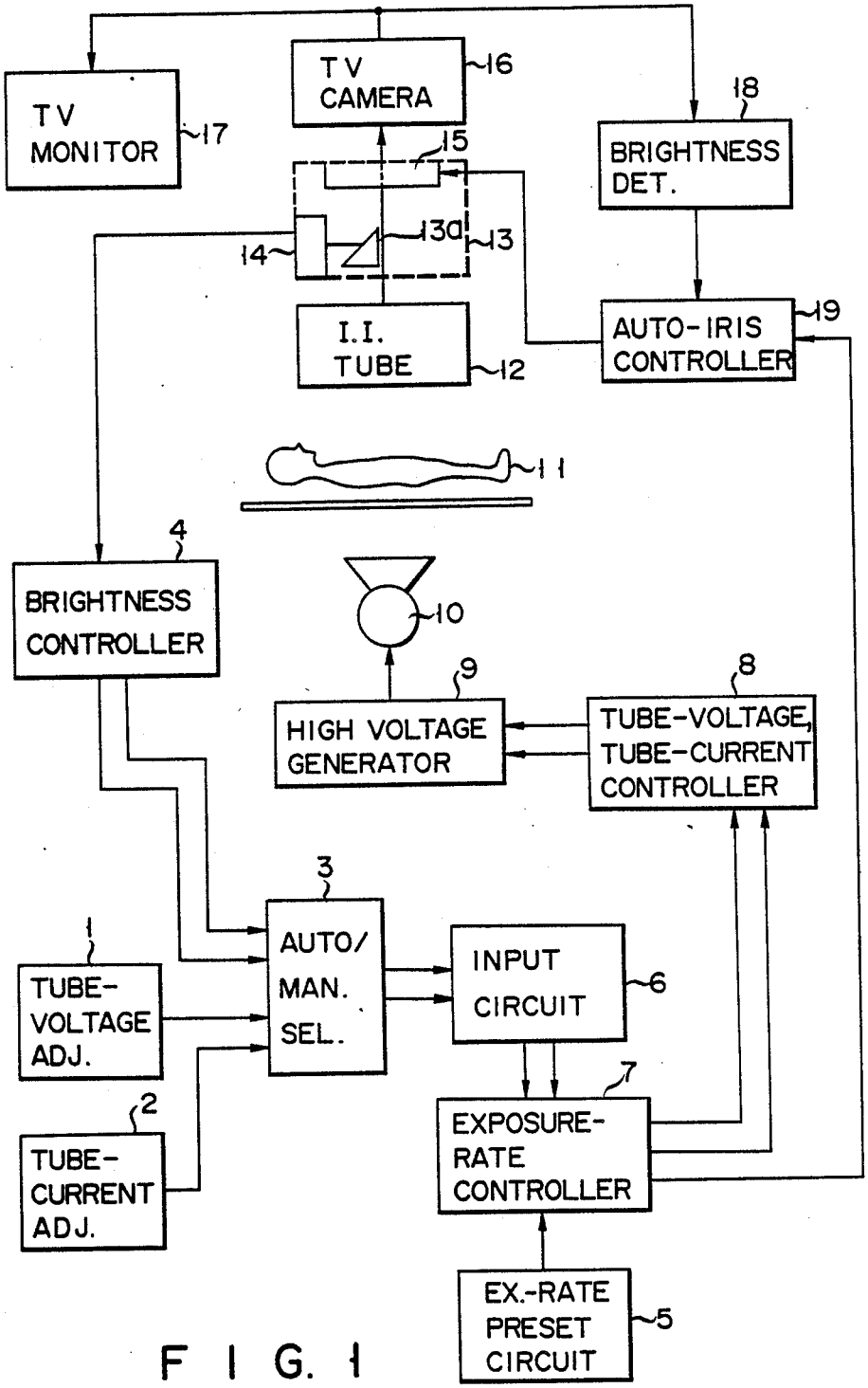
FIG. 1 is a block diagram of an X-ray fluoroscopic apparatus according to an embodiment of the present invention.

FIG. 1 is a block diagram of an X-ray fluoroscopic apparatus according to an embodiment of the present invention.

Tube-voltage adjuster 1 and tube-current adjuster 2 are arranged on the operation panel of the apparatus main body (not shown). Adjusters 1 and 2 are comprised of setting dials, analog switches, or the like. When an operator manually operates adjusters 1 and 2, a tube voltage and a tube current are set. This apparatus is not exclusively used for fluoroscopy but can also be used in photography, and indirect fluoroscopy using an image intensifier, and the like when the necessary accessories are mounted. Since the desired tube voltage and tube current differ for each operation, the tube voltage and current for fluoroscopy are referred to as an F-kV and an F-mA in this specification.

F-kV and the F-mA output from adjusters 1 and 2 are input to the manual-side input terminals of auto/manual selector 3. Another F-kV and F-mA output from brightness controller 4 are input to the auto-side input terminals of selector 3.

Brightness controller 4 detects the brightness of a fluoroscopic image from a transmitted X-ray exposure rate. This is detected by photomultiplier 14 in X-ray television optical system 13. Brightness controller 4 adjusts either the F-kV or the F-mA to set the detected brightness at a desired value, and outputs the adjusted F-kV and F-mA.

When auto/manual selector 3 is set at the manual-side, it selects outputs from adjusters 1 and 2 and outputs them to input circuit 6. When auto/manual selector 3 is set at the auto-side, it selects outputs from brightness controller 4 and outputs them to input circuit 6. Input circuit 6 holds the input F-kV and F-mA and supplies them to entrance exposure-rate controller 7.

Exposure-rate controller 7 compares an input entrance exposure rate, determined by the input F-kV and F-mA, with a preset exposure rate set by exposure-rate preset circuit 5. This is done in conformity with the safety standards considering the safety of the patient. When the input entrance exposure rate is equal to or less than the preset exposure rate, controller 7 directly supplies the F-kV and F-mA input from input circuit 6 to tube-voltage and tube-current controller 8.

On the contrary, when the input entrance exposure rate is larger than the preset exposure rate, exposure-rate controller 7 limits at least either the F-kV or F-mA input from input circuit 6 at a lower value and supplies the limited F-kV and F-mA to tube-voltage and tube-current controller 8. At the same time, controller 7 supplies a limit signal to auto-iris controller 19. This limit signal represents that at least either the F-kV or F-mA input from input circuit 6 is limited.

Tube-voltage and tube-current controller 8 supplies a primary voltage signal corresponding to the F-kV and a filament heating signal corresponding to the F-mA to the main transformer and the filament heater, respectively, of high voltage generator 9, to control them. Thus, high voltage generator 9 controls the tube voltage and current of X-ray tube 10 in accordance with the F-kV and F-mA supplied from tube-voltage and tube-current controller 8.

The X-rays output from X-ray tube 10 are transmitted through patient 11 to form a transmitted X-ray image. The transmitted X-ray image is converted into an optical image by image intensifier tube 12. After the light quantity of the optical image is reduced as required by auto-iris 15 in optical system 13, the optical image is input to TV camera 16. Photomultiplier 14 is arranged in the side portion of optical system 13 and receives the optical image from image intensifier tube 12 through photo-pickup 13*a* provided between image intensifier tube 12 and TV camera 16.

TV camera 16 picks up the received optical information, converts it into an electrical signal, and outputs the electrical signal to TV monitor 17 and brightness detector 18. Detector 18 detects the brightness of the image displayed on the screen of TV monitor 17 from the input electrical signal and outputs it to auto-iris controller 19.

Figure 2:
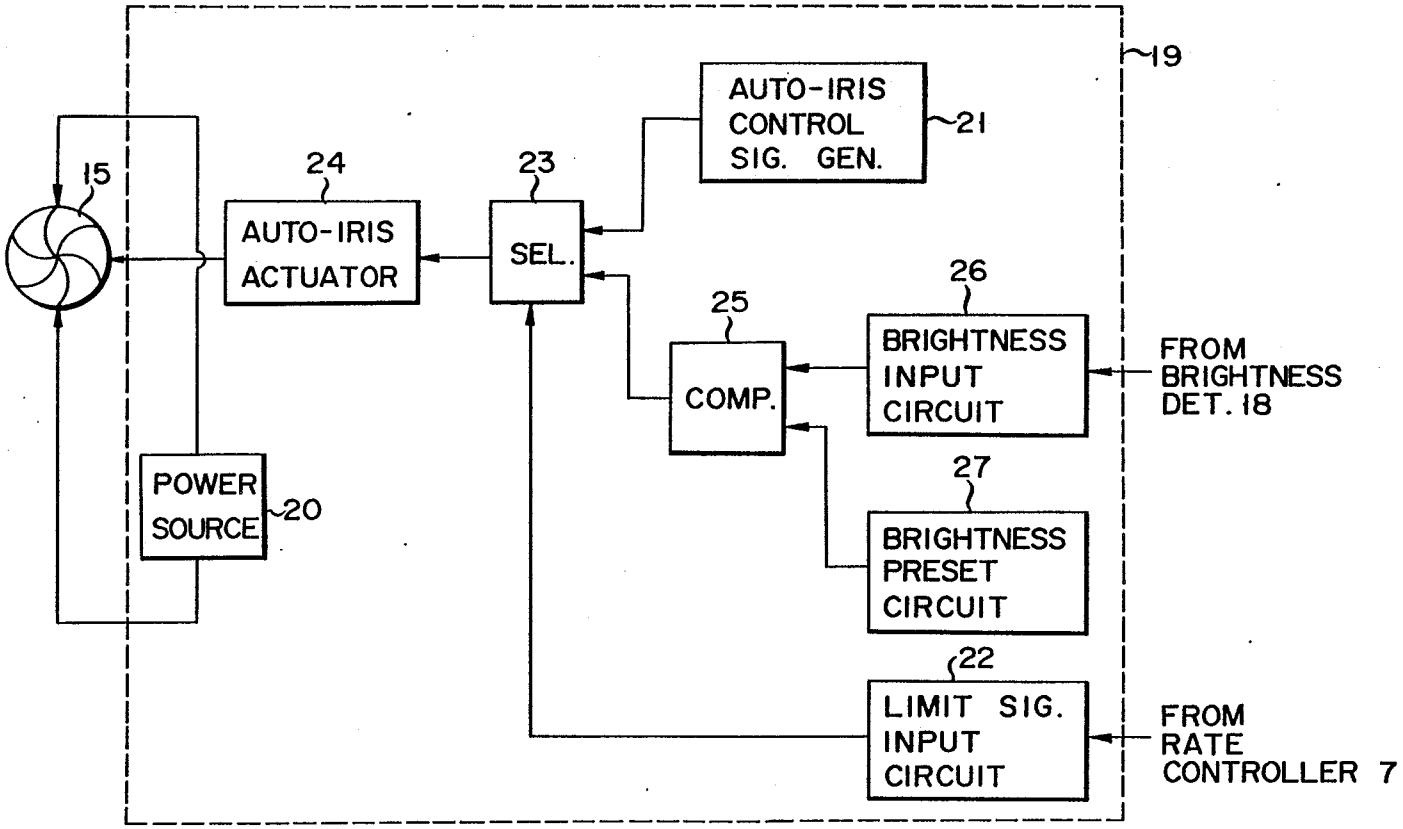
FIG. 2 is a block diagram of an auto-iris controller of the first embodiment of the present invention.

FIG. 2 is a detailed block diagram of auto-iris controller 19. Power source 20 is connected to auto-iris 15. In the normal mode wherein exposure-rate controller 7 does not limit input F-kV and/or F-mA, control of auto-iris 15 is based on a first auto-iris control signal output from auto-iris control signal generator 21. This control signal is used for closing the iris to a predetermined value in accordance with the operation mode, such as fluoroscopy, photography, indirect photography using an image intensifier, and the like and the input size of the field of view of the image intensifier tube.

The first auto-iris control signal output from auto-iris control signal generator 21 is supplied to auto-iris actuator 24 through selector 23. Selector 23 is normally switched so as to control signal generator 21.

An output from brightness detector 18 is supplied to the first input terminal of comparator 25 through brightness input circuit 26. Input circuit 26 temporarily holds the output from detector 18. Brightness preset circuit 27 generates a signal corresponding to minimizing brightness which is necessary for performing diagnosis with desired precision. An output from preset circuit 27 is connected to the second input terminal of comparator 25. Comparator 25 supplies a signal corresponding to a difference between the two input signals to selector 23 as the second auto-iris control signal.

The limit signal from exposure rate controller 7 is supplied to the control terminal of selector 23 through limit signal input circuit 22. Input circuit 22 temporarily holds the limit signal. Upon reception of the limit signal, selector 23 is switched from the control signal generator 21 to the comparator 25 and supplies the second auto-iris control signal from comparator 25 to auto-iris actuator 24.

The operation of this embodiment will be described.

Usual fluoroscopy, i.e., fluoroscopy of a patient having a thin body will first be described. When selector 3 is switched to the manual-side, the operator manually operates tube-voltage and tube-current adjusters 1 and 2 while he observes TV monitor 17 so that the brightness of the image on the screen is the desired value, thus setting the tube voltage and tube current. When selector 3 is switched to the auto-side, desired tube voltage and tube current are automatically set in accordance with the output from brightness controller 4. In the case of fluoroscopy of a patient having a thin body, the input entrance exposure rate is determined in accordance with the F-kV and F-mA set in this manner will not coincide with nor exceed the preset exposure rate output from rate preset circuit 5. Therefore, exposure-rate controller 7 does not limit the exposure rate yet supplies the F-kV and F-mA input from input circuit 6 directly to tube-voltage and tube-current controller 8. As a result, X-ray tube 10 irradiates patient 11 with X-rays at such an entrance exposure rate that the brightness of the image on the screen of TV monitor 17 becomes a desired value even when auto-iris 15 is closed to prevent shading.

In this case, no limit signal is generated, and thus auto-iris controller 18 performs with normal control. More specifically, selector 23 selects the output from controller 21 and supplies it to auto-iris actuator 24 to close auto-iris 15 in accordance with the operation mode.

As a result, a fluoroscopic image having a desired brightness is displayed on TV monitor 17. Since the entrance exposure rate does not exceed the value determined by the safety standards, the patient's body is not adversely affected by the X-rays.

Fluoroscopy of a patient having a thick body will now be described. In this case, the transmitted X-ray quantity is small. Therefore, the entrance exposure rate which is determined in accordance with the tube voltage and current that are manually or automatically set in order to obtain an image having a desired brightness on the screen of TV monitor 17 which coincides with or exceeds the preset exposure rate output from rate preset circuit 5. Thus, when these tube voltage and tube current are directly set in high voltage generator 9, large quantities of X-rays are radiated onto the patient, which is dangerous. Therefore in order to limit the entrance exposure rate, exposure rate controller 7 at least limits either the F-kV or F-mA input from input circuit 6 at a smaller value. This causes the entrance exposure rate to coincide with the preset exposure rate, and sets the tube voltage and tube current corresponding to the preset exposure rate in generator 9. As a result, the X-ray quantity transmitted through the patient is still insufficient for displaying a fluoroscopic image with the desired brightness on TV monitor 17.

However, since exposure-rate controller 7 supplies a limit signal to auto-iris controller 19, controller 19 does not perform the normal control but performs a feedback control based on the signal supplied from TV camera 16. More specifically, selector 23 selects the output from comparator 25 and supplies it to auto-iris actuator 24. The brightness detected by brightness detector 18 is less than the brightness set by preset circuit 27, and comparator 25 outputs a signal corresponding to the difference between these two brightness values. Thus, actuator 24 keeps opening auto-iris 15 until the detected brightness coincides with the preset brightness.

As a result, even when the X-ray quantity radiated to the patient is limited considering patient's safety, a fluoroscopic image having a desired brightness can be displayed on TV monitor 17 by opening iris 15 of TV camera 16. This is usually closed for the purpose of preventing shading.

The present invention is not limited to the specific embodiment described above but can be modified in various manners. For example, in the embodiment, the functions of exposure rate control, auto-iris control, and the like are achieved by separate circuits. However, these functions can be realized in a software manner by using an arithmetic processing unit such as a CPU. The brightness of an X-ray fluoroscopic image is not limited to be only detected based on the signal from the TV camera. A brightness meter may be arranged in front of the screen of TV monitor 17, and the brightness of the screen of TV monitor 17 may be measured directly.

As described above, according to the present invention, there is provided an x-ray fluoroscopic apparatus wherein an image having a desired brightness can always be displayed on a monitor by opening the iris of the TV camera while limiting an entrance exposure rate to decrease the X-ray quantity radiated on a patient, thus enabling high-precision diagnosis.

What is claimed is:

1. An X-ray fluoroscopic apparatus comprising:

fluoroscope means for obtaining a fluoroscopic image of an object to be examined by detecting X-rays radiated by an X-ray tube and transmitted through the object;

camera means, having an iris closed to a predetermined setting, for receiving through the iris a fluoroscopic image of the object obtained from X-rays transmitted through the object;

input means for inputting an entrance exposure rate of the X-rays radiated by said X-ray tube; and exposure rate setting means, connected to said fluoroscope means and said input means, for comparing the entrance exposure rate with a predetermined reference exposure rate, and for applying in said X-ray tube a tube current and a tube voltage which are determined in accordance with the entrance exposure rate input by said input means;

said exposure rate setting means having means for adjusting said iris to a predetermined setting when the input entrance exposure rate is less than the reference exposure rate; and said exposure rate setting means having means for opening said iris such that the brightness of an image received by said camera means becomes a desired value when the entrance exposure rate input by said input means is greater than the reference rate.

2. An apparatus according to claim 1, in which said camera means comprises:

an image intensifier tube for converting an image of the X-rays transmitted through the object into an optical image;

a television camera for picking up an optical image output from said image intensifier tube; and an iris provided in a lens system between said image intensifier tube and said television camera and open to a setting in accordance with an input diameter of a field of view of said image intensifier tube.

3. An apparatus according to claim 1, in which said exposure rate setting means comprises at least one:

means for manually inputting a tube current and a tube voltage of said X-ray tube; and means for detecting a brightness of an image received by said camera means and automatically inputting a tube current and a tube voltage of said X-ray tube in accordance with a difference between the detected brightness and a desired brightness.

4. An apparatus according to claim 3, in which said input means comprises means for detecting the brightness of the image received by said camera means based on an output signal from said camera means.

5. An apparatus according to claim 3, in which said input means comprises:

means for displaying an output image of said camera means; and means, arranged in front of a screen of said means for displaying for measuring the brightness of the screen.

6. An apparatus according to claim 1, in which said exposure rate setting means comprises:

means for generating a control signal when the input entrance exposure rate is larger than the reference exposure rate; and iris control means for closing said iris to a predetermined setting when no control signal is generated, and for opening said iris until the brightness of an image picked up by said camera means coincides with a desired brightness.

7. An apparatus according to claim 6, in which said iris control means comprises:

means for generating a first control signal for setting said iris at a predetermined value;

means for generating a second control signal for setting said iris such that the brightness of the image received by said camera means is at a value coinciding with the desired brightness;

means, connected to said first and second signal generating means, for selecting the first control signal when no control signal is generated and the second control signal when a control signal is generated; and iris actuating means for actuating said iris by an output from said selecting means.

8. An X-ray fluoroscopic apparatus comprising:

means for radiating X-rays onto an object to be examined;

an image intensifier tube for converting an image formed by X-rays transmitted through the object into an optical image;

means for reducing a diameter of an optical image output from said image intensifier tube by an iris and displaying the reduced optical image;

means for detecting a transmitted X-ray quantity from the optical image which is output from said image intensifier tube whose diameter is reduced;

determination means for determining an exposure rate of said X-ray radiating means in accordance with a detected transmitted X-ray quantity;

means for comparing the determined exposure rate with a reference exposure rate;

means for setting a voltage and a current of said X-ray radiating means in accordance with the determined exposure rate when the determined exposure rate is not greater than the reference exposure rate;

means for setting a voltage and a current of said X-ray radiating means in accordance with the reference exposure rate and generating a limit signal when the determined exposure rate is greater than the reference exposure rate; and means, in response to the limit signal, for detecting a brightness of a displayed image and for opening said iris such that the detected brightness coincides with a predetermined brightness.

* * * * *